US005727496A

United States Patent [19]

Welch, Jr.

[11] Patent Number: 5,727,496

[45] Date of Patent: Mar. 17, 1998

[54] TRANSPORT VEHICLE HULL

[75] Inventor: Kenneth W. Welch, Jr., Houston, Tex.

[73] Assignee: Global Oceanic Designs Ltd., Houston, Tex.

[21] Appl. No.: 642,751

[22] Filed: May 3, 1996

[51] Int. Cl.[6] ..... B63B 3/13

[52] U.S. Cl. ..... 114/312; 114/56; 114/341

[58] Field of Search ..... 114/61, 341, 342, 114/312, 56, 257, 292; 244/158 R, 119

[56] References Cited

U.S. PATENT DOCUMENTS

| | | | |
|---|---|---|---|
| 3,063,398 | 11/1962 | Yohe | 114/292 |
| 3,228,550 | 1/1966 | Krenzke | 220/3 |
| 3,257,718 | 6/1966 | Krenzke | 29/404 |
| 3,280,775 | 10/1966 | Krenzke | 114/16 |
| 3,400,679 | 9/1968 | Barhite et al. | 114/312 |
| 3,400,848 | 9/1968 | Shaler et al. | 220/5 |
| 3,613,615 | 10/1971 | Sturm | 114/16 |
| 3,635,183 | 1/1972 | Keatinge | 114/16 R |
| 3,656,445 | 4/1972 | Padwick | 114/61 |
| 4,058,945 | 11/1977 | Knapp | 52/244 |
| 4,627,372 | 12/1986 | Douglas Iii | 114/352 |
| 4,928,614 | 5/1990 | Forman | 114/66 |
| 4,938,164 | 7/1990 | Onofri | 114/312 |
| 4,961,397 | 10/1990 | Trone | 114/354 |
| 5,005,510 | 4/1991 | Schad | 114/357 |
| 5,249,997 | 10/1993 | Nance | 441/1 |
| 5,544,610 | 8/1996 | Harding | 114/312 |

OTHER PUBLICATIONS

Development of Submarines, *The New Encyclopedia Britannica*, vol. 29, pp. 610–616 (1987).

*Primary Examiner*—Sherman Basinger

*Attorney, Agent, or Firm*—Vaden, Eickenroht & Thompson, L.L.P.

[57] ABSTRACT

A transport vessel hull is provided for withstanding great pressure differential between the environments inside and outside the hull, and includes an enclosed hexahedral housing having a substantially diamond-shaped cross section with a long diagonal oriented horizontally and a short diagonal oriented vertically. A support structure is contained within the housing for bearing the loads resulting from the pressure differential across the hull, and includes a plurality of vertical frame members connected at the upper and lower ends thereof to the housing on either respective side of the short diagonal to form a plurality of high strength-to-weight ratio trusses.

9 Claims, 3 Drawing Sheets

FIG. 1
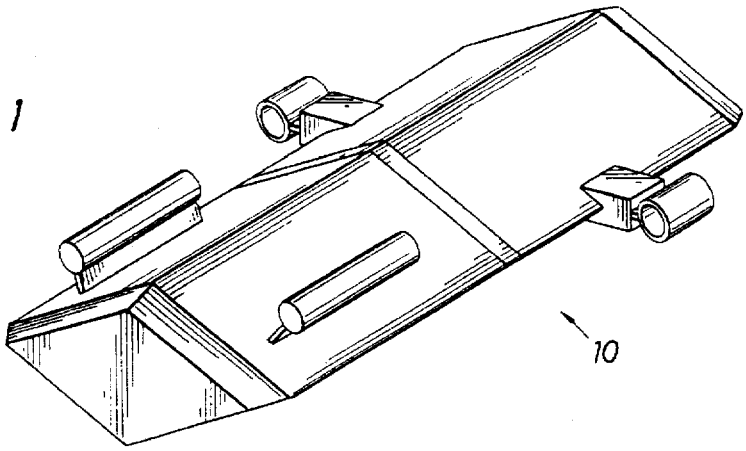
FIG. 2
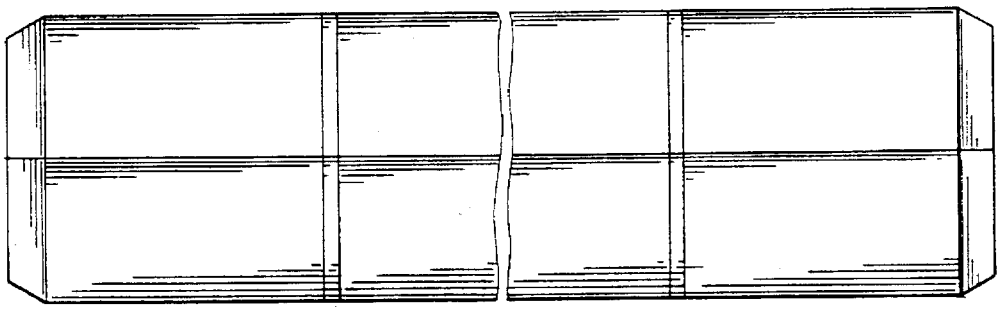
FIG. 3
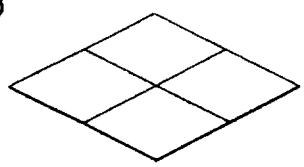
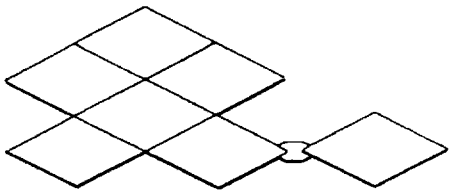
FIG. 4
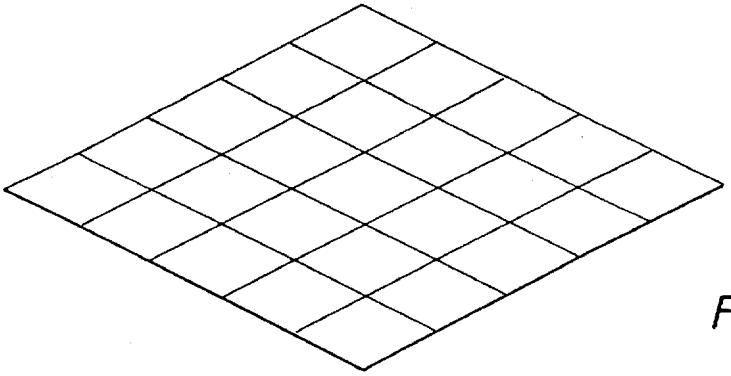
FIG. 5

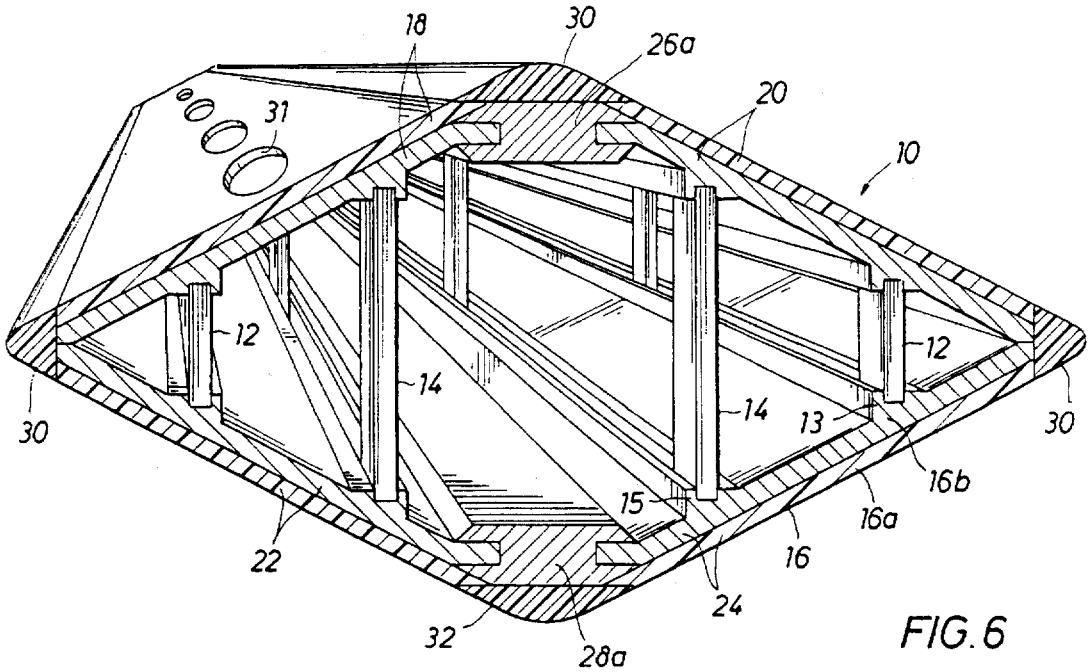
FIG. 6
FIG. 7
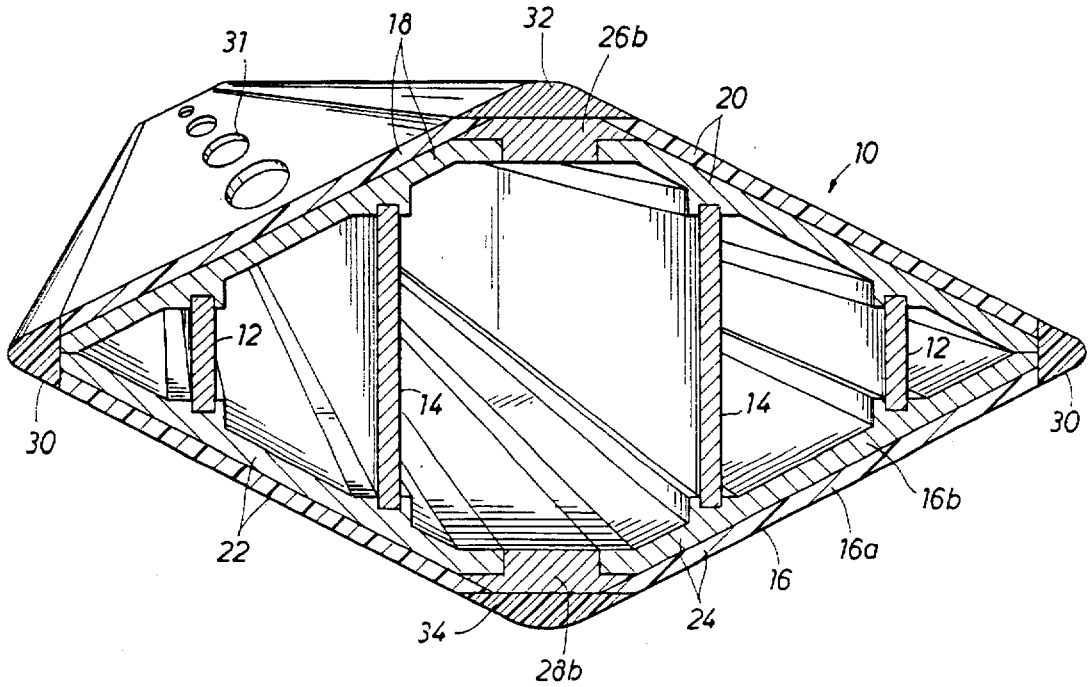

TRANSPORT VEHICLE HULL

BACKGROUND OF THE INVENTION

1. Field of the Invention

The present invention relates to vessels capable of withstanding great pressure differentials between the environments inside and outside the vessel. More particularly, the present invention relates to submersible hulls.

2. The Related Art

For centuries, man has attempted to descend into the oceans for scientific observation, salvage and rescue operations, animal and mineral harvesting, and attacking enemy ships in times of war. Often, such activities require vessels capable of submerging to great depths. Thus, the foremost concern in designing and fabricating the hull of a deep submergence vessel is that the hull be strong enough to resist the large crushing forces resulting from hydrostatic pressure. For this reason, submarines have been typically constructed of welded steel that is several inches thick.

However, there are many disadvantages of such construction. The thickness of the hull makes rolling and welding operations extremely difficult. Also, the resulting weight of the welded steel structure is immense and it impacts buoyancy and maneuverability. Furthermore, the substantially tubular, elongated structure of a typical submarine hull is impossible to shape without specialized components.

Several solutions have been proposed to these problems, including U.S. Pat. No. 3,400,848 which describes a hull structure constructed of specialized high-strength, low density materials and having honeycombed interior surfaces formed by a plurality of "recesses". The exterior surfaces include a hemispherical bow section, a conical nose section, and central cylindrical sections. Thus, the hull of this patent is limited to a selection of certain materials, and is difficult and time-consuming to construct in view of the interior recesses and the exterior shape.

U.S. Pat. No. 3,228,550 describes a pressure vessel having a composite hollow body formed of an external jacket containing a plurality of unattached blocks having high strength-to-weight ratios. The jacket is said to resist bending while the blocks are said to resist compressive loads, but the jacket is made of metal which must be rolled and welded to form the desired tubular shape of the vessel.

U.S. Pat. No. 4,928,614 discloses a submersible observation vehicle constructed of three interconnected transparent acrylic cylinders. The acrylic hull lacks any substantial structural support, however, which makes the vehicle unsuitable for the hydrostatic pressures characteristic of deep submergence.

In response to these deficiencies in the art, it is an object of the present invention to provide a transport vessel hull that is suitable for very deep submergence and which requires no rolling or welding to fabricate.

It is a further object of the present invention to provide a transport vessel hull that is constructed substantially of flat stock materials.

It is a further object of the present invention to provide viewing ports to enable passengers within the transport vessel to observe the environment outside the vessel.

It is a further object to provide a support structure that facilitates the provision of passageways and separated compartments within the transport vessel.

It is a further object to provide a transport vessel hull that is suitable for use as an outer space vessel as well as in a submarine, or submersible habitat.

SUMMARY OF THE INVENTION

The objects described above, as well as other objects and advantages are achieved by a transport vessel hull that includes an enclosed hexahedral housing having a substantially diamond-shaped cross section with a long diagonal oriented horizontally and a short diagonal oriented vertically. A support structure is contained within the housing for bearing the loads resulting from the pressure differential across the hull, and includes a plurality of vertical frame members connected at the upper and lower ends thereof to the housing on either respective side of the short diagonal to form a plurality of high strength-to-weight ratio trusses.

In a preferred embodiment, the housing includes four side walls arranged and connected substantially edge-to-edge to form the diamond-shaped cross section, and a pair of diamond-shaped end walls connected to the respective ends of the side walls for enclosing the housing. The housing has interior angles between adjacent side walls of substantially 54° and 126°. The housing has a length that is substantially equal to the width along its long diagonal. The vertical frame members may be either columns positioned at spaced intervals throughout the length of the housing, or walls that extend the length of the housing. Both the housing and the support structure are substantially composed of flat stock materials.

In another embodiment, the transport vessel hull further includes a vertical frame member providing support through the short diagonal of the housing and a horizontal frame member providing support through the long diagonal of the housing. A plurality of horizontal frame members provide further support above and below the long diagonal of the housing, as do a plurality of frame members inclined at 45° angles from the short diagonal of the housing. These frame members form an integrated network of high strength-to-weight ratio trusses for bearing the loads applied to the hull.

The transport hull may be outfitted as a submarine hull by making at least a portion of the housing transparent for providing visual access to the ocean environment outside the hull, and by mounting ballast tanks within the support structure for achieving negative, neutral, and positive buoyancy within the hull.

BRIEF DESCRIPTION OF THE DRAWINGS

In the drawings, wherein like reference characters are used throughout to describe like parts:

FIG. 1 is a perspective view of a submarine including a double-length hull design in accordance with the present invention;

FIG. 2 is a plan view of a multiple-pod hull in accordance with the present invention;

FIGS. 3–5 are elevational views of various multiple-pod configurations of the present hull design;

FIG. 6 is a perspective sectional view of one embodiment of the hull equipped for low external pressure, such as outer space, and having a double-layer housing;

FIG. 7 is a perspective sectional view of the embodiment of FIG. 6 equipped for great external pressure, such as deep sea submergence;

DETAILED DESCRIPTION OF THE PREFERRED EMBODIMENT

Figure 8:
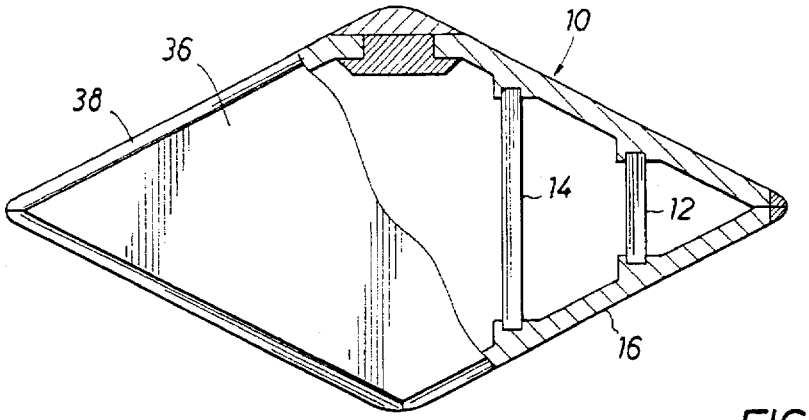
FIG. 8 is an elevational view, partly in section, of the embodiment of FIG. 6 having a single-layer housing.

FIG. 1 illustrates a submarine incorporating transport hull 10 of the present invention in a double-length variation. Hull 10 is capable of fabrication in many different sizes and lengths, as illustrated by the various configurations of FIGS. 2–5. Thus, multiple "pods" each constructed in accordance with the present hull design may be interconnected end-to-end, side-to-side, or edge-to-edge, to construct an infinite variety of transport vessels, or stationery habitats.

Of equal importance, however, is the fact that hull 10 is capable of being constructed of flat stock of virtually any material due to the optimum load-bearing characteristics achieved by its novel diamond-shaped cross-section and its internal support structure (discussed further below). Thus, the specialty fabrication required of conventional spherical and cylindrical hull designs is eliminated. Furthermore, submersible hulls may be constructed in accordance with this invention without nuts, bolts, or screws, which further simplifies the manufacturing process.

It is believed that the diamond-shaped cross section provides hull 10 with more usable space per foot of length than conventional hull designs. The linear nature of hull 10 also allows full manipulation of the material type, strength, and thickness, resulting in maximum flexibility from a manufacturing standpoint when varying design parameters.

Transport hull 10 is believed to be suitable for use as an outer space vessel as well as for a submarine, submersible habitat, or other pressure vessel applications, but the description that follows will be primarily limited to submarine applications because submarines must withstand a much greater pressure differential between the environments inside and outside the hull than other types of vessels. Submarines will therefore utilize the excellent load-bearing capabilities of the present invention to the fullest extent.

With reference now to FIGS. 6 and 7, hull 10 includes an enclosed hexahedral (six-sided) housing 16 with the long diagonal of the diamond-shaped cross-section oriented horizontally and the short diagonal oriented vertically. A support structure is contained within housing 16 for bearing the loads resulting from the pressure differential across the hull, and includes a plurality of vertical frame members 12, 14 connected at the upper and lower ends thereof to grooved shoulders 13, 15 in housing 16 on either respective side of the short diagonal to form a plurality of triangular, high strength-to-weight ratio trusses. As indicated earlier, both the housing and the support structure are substantially composed of flat stock materials. In the particular embodiments shown in FIGS. 6 and 7, housing 16 is a double layer design that includes an internal layer 16*b* of steel encased in an external layer 16*a* of Acrylite GP, or similar transparent material.

Housing 16 includes four double-layer side walls 18, 20, 22, and 24 arranged and connected substantially edge-to-edge to form the diamond-shaped cross section. The housing has interior angles between adjacent side walls of substantially 54° and 126°. Thus, the angle between walls 18 and 22, and walls 20 and 24, is 54° while the angle between walls 18 and 20, and walls 22 and 24, is 126°. These are believed to be the optimum wall angles for bearing the loads of external fluid pressure, in cooperation with the support structure. The single-pod housing has a length that is substantially equal to the width along its long diagonal, which also optimizes the structural integrity of hull 10.

The side walls are connected to one another with tongue members 26*a*, 28*a* positioned in the grooves between walls 18 and 20, and walls 22 and 24, respectively, as shown in FIG. 6. Similarly, the walls of the variation shown in FIG. 7 are connected with tongue members 26*b*, 28*b*. The difference between the tongue members of FIGS. 6 and 7 is that the former are adapted for containing greater pressure within the hull than outside the hull, such as in outer space. The tongue members of FIG. 7 are well suited for bearing the great external pressures resulting from deep sea submergence. Those skilled in the art will appreciate that other means of connection are equally suitable for this purpose, including pins, keys, or splines. The connected edges of the side walls are finished with rounded side, crown, and bottom caps 30, 32, and 34, respectively, to give hull 10 a smooth, streamlined shape. A pair of diamond-shaped end walls 36 (see FIG. 8) are connected to the respective ends of the side walls for enclosing the housing.

Vertical frame members 12, 14 may be either columns positioned at spaced intervals throughout the length of the housing, as shown in FIG. 6, or walls that extend the length of the housing, as seen in FIG. 7. Either are suitable for very deep submergence, but the use of walls over columns increases the load-bearing capacity of hull 10.

A prototype of this embodiment of the invention, named "Crystal Quest II," was constructed of a composite housing having a 1½ inch thick steel internal layer encased in a ½ inch thick external layer of Acrylite GP, much like the two-layer housings illustrated in FIGS. 6 and 7. The vertical frame members of the support structure were steel columns having a 1 inch by ½ inch cross-section. The overall housing was 14 inches in height (short diagonal of the diamond), 27 inches in width (long diagonal of the diamond), and 29 inches in length. Both end walls of the housing were provided with large primary viewing ports and smaller secondary and still smaller lighting ports by cutting openings in the steel layer of each end wall and fitting the void in the steel layer with ½ inch of the acrylic material. Each of the four side walls similarly contained four colinear secondary viewing ports 31 for modeling the optimum viewing and/or filming capacities of the hull. Crystal Quest II was submitted to an external hydrostatic pressure test at the Marine Technology Laboratory of the Southwest Research Institute and withstood pressures up to 1,641 psig, an equivalent depth of approximately 3,750 feet, before failing.

FIG. 8 illustrates hull 10 having single-layer housing 16 composed of one material such as steel, aluminum, or acrylic. Rounded edge caps 38 provide a smooth transition between the ends of the side walls and the respective end walls 36.

Figure 9:
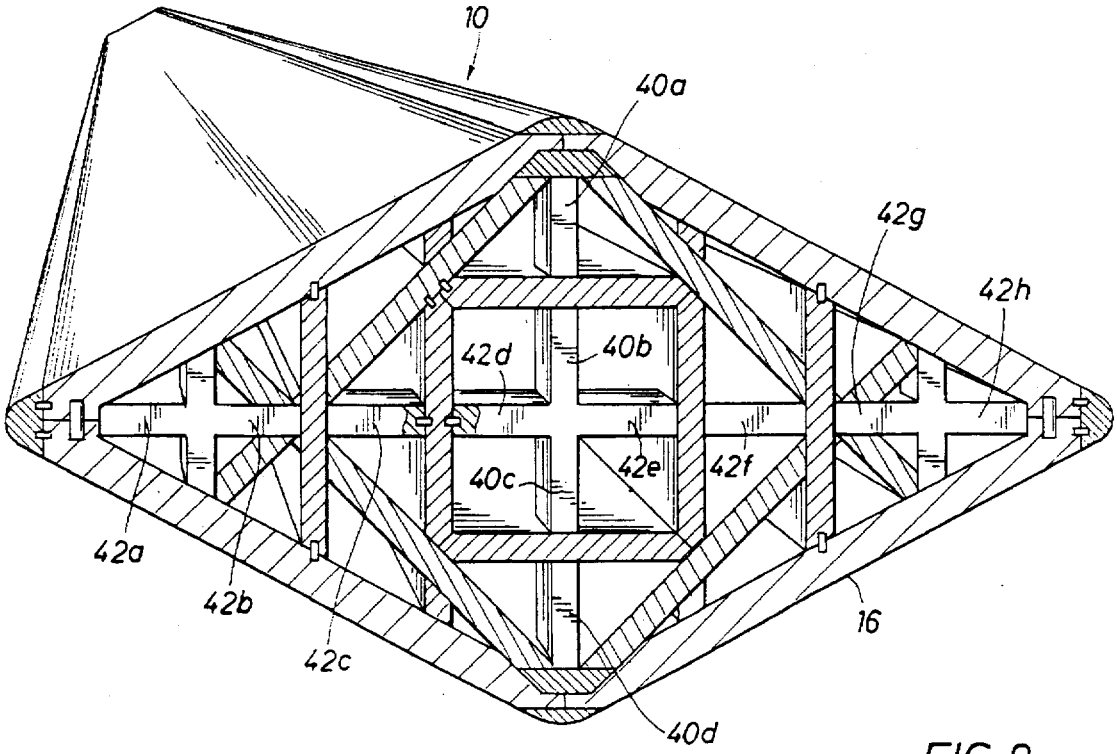
FIG. 9 is a perspective sectional view of a second embodiment of the hull having a single-layer housing.

In another embodiment, shown in FIG. 9, submarine hull 10 further includes an additional vertical frame member having multiple sections 40*a–d* for providing support through the short diagonal of the housing, and a horizontal frame member having multiple sections 42*a–h* for providing support through the long diagonal of the housing. A plurality of additional horizontal frame members provide further support above and below the long diagonal of the housing, as do a plurality of frame members inclined at 45° angles from the short diagonal of the housing. These many frame members are connected to one another and to the side walls via pins or similar means, and form an integrated network of high strength-to-weight ratio trusses for bearing the external fluid loads applied to the hull. In the particular embodiment shown, the frame members that are continuous throughout the length of hull 10, in the sense of walls, are shown cross-hatched. Those frame members that are provided as beams or studs are not cross-hatched. For example, the vertical sections 40*a–d* are beam sections that are duplicated at spaced intervals throughout the length of the hull.

Two prototypes of this embodiment have been constructed and tested. The first, named "Mosquito Hawk I,"

was constructed entirely of flat wood stock. Specifically, the housing side walls and end walls were constructed of 1 inch thick Poplar wood. The vertical, horizontal, and inclined frame members were all 1 inch by 1 inch wood studs. The individual stud members were pinned and glued together without any other fasteners, and the housing walls were then laminated in place. The Mosquito Hawk I was also submitted to an external hydrostatic pressure test at the Marine Technology Laboratory of the Southwest Research Institute and withstood pressures up to 172 psig, an equivalent depth of approximately 363 feet. This is believed to be the deepest performance ever by any wood submersible vessel.

The second prototype of the second embodiment of the present invention, named "Crystal Quest I," was a double-length hull design constructed entirely of Acrylite GP flat stock. Thus, the length of the hull was approximately twice the width of the hull. Again, no fasteners of any kind were used. The housing was formed of two 1 inch thick layers of the acrylic material that were joined by lamination using a common bonding agent. The vertical, horizontal, and inclined frame members were 1 inch by 1 inch acrylic studs. Crystal Quest I withstood pressure testing up to 781 psig, or a depth equivalent of approximately 1768 feet, before failing. It is believed that a similarly constructed single-length hull of all acrylic materials would perform to approximately double this depth before failing.

Based upon the test data collected and the inventor's observations, hull 10 can achieve positive buoyancy, i.e., it will float unassisted on the surface, in virtually any selection of flat stock materials for its construction. Submergence may be achieved by flooding water ballast tanks (not shown) mounted to the hull, or by flooding ballast compartments defined by the support structure members, until neutral buoyancy is achieved. The propulsion system provided for the submarine utilizing hull 10 would produce diving by appropriately directing diving planes on the submarine. To surface, the submarine would adjust the diving planes appropriately and empty the water from the ballast tanks, or ballast compartments using compressed air stored on board.

Those skilled in the art will appreciate that the support system and frame members of the present hull design are well suited for creating segregated compartments for storage of mechanical, electrical, ballast, and fuel components, etc., as well as for habitation, recreation, and other uses, depending on the overall size of the hull. Furthermore, passageways may be bored through many of the frame members to connect the compartments without appreciable loss of load-bearing capacity.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A transport vessel hull capable of withstanding great pressure differential between the environments inside and outside the hull, comprising:

an enclosed hexahedral housing having a substantially diamond-shaped cross section with a long diagonal oriented horizontally and a short diagonal oriented vertically; and a symmetrical support structure within said housing for bearing the loads resulting from the pressure differential across the hull, said support structure including a plurality of transversely spaced vertical frame members each connected at the upper and lower ends thereof to said housing on either respective side of the short diagonal to form a plurality of high strength-to-weight ratio trusses, said housing and said support structure together forming at least one enclosed space for transporting cargo or passengers.

2. The transport vessel hull of claim 1 wherein said housing includes four side walls arranged and connected substantially edge-to-edge to form the diamond-shaped cross section, and a pair of diamond-shaped end walls connected to the respective ends of the side walls for enclosing said housing.

3. The transport vessel hull of claim 2 wherein said housing has interior angles between adjacent side walls of substantially 54° and 126°.

4. The transport vessel hull of claim 1 wherein said housing has a length that is substantially equal to the width along its long diagonal.

5. The transport vessel hull of claim 4 wherein the vertical frame members are columns positioned at spaced intervals throughout the length of said housing.

6. The transport vessel hull of claim 4 wherein the vertical frame members are walls that extend the length of said housing.

7. The transport vessel hull of claim 1 wherein said support structure further includes:

a vertical frame member providing support through the short diagonal of said housing;

a horizontal frame member providing support through the long diagonal of said housing;

a plurality of horizontal frame members providing support above and below the long diagonal of said housing; and a plurality of frame members inclined at 45° angles from the short diagonal of said housing, said frame members forming an integrated network of high strength-to-weight ratio trusses for bearing the loads applied to the hull.

8. The transport vessel hull of claim 1 wherein said housing and said support structure are substantially composed of flat stock materials.

9. A submarine hull capable of withstanding great hydrostatic pressure, comprising:

an enclosed hexahedral housing having a substantially diamond-shaped cross section with a long diagonal oriented horizontally and a short diagonal oriented vertically, at least a portion of said housing being transparent for providing visual access; and a symmetrical support structure within said housing for bearing the loads resulting from the pressure differential across the hull, said support structure including a plurality of transversely spaced vertical frame members each connected at the upper and lower ends thereof to said housing on either respective side of the short diagonal to form a plurality of high strength-to-weight ratio trusses, said housing and said support structure together forming at least one enclosed space for transporting cargo or passengers.

* * * * *

UNITED STATES PATENT AND TRADEMARK OFFICE

CERTIFICATE OF CORRECTION

PATENT NO. : 5,727,496
DATED : March 17, 1998
INVENTOR(S) : Kenneth W. Welch, Jr.

It is certified that error appears in the above-indentified patent and that said Letters Patent is hereby corrected as shown below:

Col. 4, line 21, change "1/2" to --1-1/2--.
Col. 4, line 21, change "1 1/2" to --1/2--.

Signed and Sealed this

Fourteenth Day of July, 1998

Bruce Lehman

*Attest:*

BRUCE LEHMAN

*Attesting Officer*

*Commissioner of Patents and Trademarks*